US008875539B2

(12) United States Patent
Kim

(10) Patent No.: US 8,875,539 B2
(45) Date of Patent: Nov. 4, 2014

(54) REFRIGERATOR

(75) Inventor: Joohyun Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 151 days.

(21) Appl. No.: 13/540,692

(22) Filed: Jul. 3, 2012

(65) Prior Publication Data

US 2013/0019629 A1 Jan. 24, 2013

(30) Foreign Application Priority Data

Jul. 20, 2011 (KR) ..... 10-2011-0071818

(51) Int. Cl.
*F25D 17/04* (2006.01)
*F25D 23/00* (2006.01)

(52) U.S. Cl.
CPC ..... *F25D 23/003* (2013.01); *F25D 2400/14* (2013.01); *F25D 2323/0022* (2013.01); *F25D 2323/0023* (2013.01); *F25D 2323/0021* (2013.01)
USPC ..... 62/408; 62/411; 62/441

(58) Field of Classification Search
CPC ... F25D 17/045; F25D 17/065; F25D 49/027; F25D 2400/14; F25D 23/003; F25D 2323/0022; F25D 2323/0021; F24F 1/0007; F25B 2400/075
USPC ..... 62/408, 407, 411, 414, 181, 510, 441
See application file for complete search history.

(56) References Cited

U.S. PATENT DOCUMENTS

| | | | | | |
|---|---|---|---|---|---|
| 5,205,130 | A * | 4/1993 | Pannell | 62/236 |
| 5,307,645 | A * | 5/1994 | Pannell | 62/244 |
| 5,388,427 | A * | 2/1995 | Lee | 62/331 |
| 5,392,615 | A * | 2/1995 | Lim | 62/414 |
| 5,421,247 | A * | 6/1995 | Shim | 99/468 |
| 2010/0326109 | A1 * | 12/2010 | Tobe et al. | 62/228.1 |
| 2011/0030402 | A1 * | 2/2011 | Shinya et al. | 62/186 |

FOREIGN PATENT DOCUMENTS

| | | | |
|---|---|---|---|
| CN | 1069963 | 8/2001 | |
| CN | 1648566 | 8/2005 | |
| CN | 101749914 | 6/2010 | |
| CN | 101809388 | 8/2010 | |
| JP | 2006-17338 A * | 1/2006 | F25D 19/00 |
| JP | 2006017338 | 1/2006 | |

OTHER PUBLICATIONS

Abstract of JP 2006-17338 A to Noguchi, Akihiro.*
Translation of JP 2006-17338 to Noguchi, Akihiro.*
Chinese Office Action issued in Application No. 201210233302.4 dated Mar. 11, 2014.

* cited by examiner

*Primary Examiner* — Mohammad M Ali
(74) *Attorney, Agent, or Firm* — Ked & Associates, LLP

(57) ABSTRACT

A refrigerator is provided. The refrigerator may include two compressors and two condensers disposed in a machinery compartment. The refrigerator may employ a single fan, also provided in the machinery compartment, to blow air to the two compressors and the two condensers.

11 Claims, 4 Drawing Sheets

REFRIGERATOR

CROSS-REFERENCE TO RELATED APPLICATION(S)

This application claims priority under 35 U.S.C. §119 to Korean Application No. 10-2011-0071818 filed on Jul. 20, 2011, whose entire disclosure is hereby incorporated by reference.

BACKGROUND

1. Field

This relates to a refrigerator, and more particularly, to a refrigerator having two compressors and a single fan to blow air to the compressors.

2. Background

Generally, a refrigerator supplies cool air generated by a refrigeration cycle device including a compressor, a condenser, a fan, an expansion device and an evaporator into a cooler compartment, such as a refrigerator compartment and/or a freezer compartment, to maintain items at a relatively low temperature state. In such a refrigeration cycle device the compressor may compress refrigerant, the condenser may condense the refrigerant compressed by the compressor, the expansion device may expand the condensed refrigerant, and the evaporator may evaporate the expanded refrigerant to absorb heat from surrounding air to generate a low temperature atmosphere. The compressor, the condenser, and the fan may be installed in a machinery compartment of the refrigerator.

BRIEF DESCRIPTION OF THE DRAWINGS

The embodiments will be described in detail with reference to the following drawings in which like reference numerals refer to like elements wherein.

DETAILED DESCRIPTION

Reference will now be made in detail to various embodiments, examples of which are illustrated in the accompanying drawings. Wherever possible, the same reference numbers will be used throughout the drawings to refer to the same or like parts.

Figure 1:
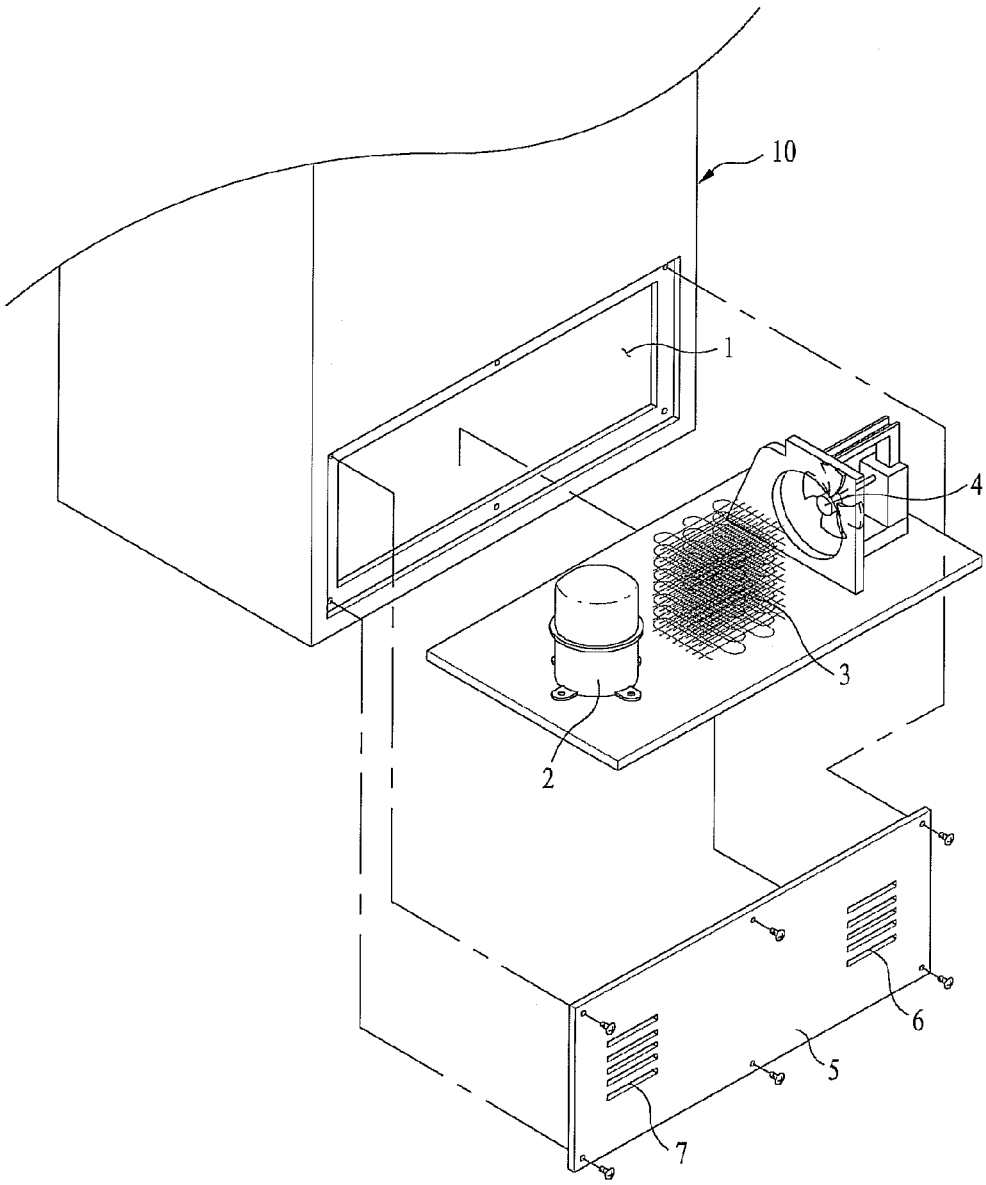
FIG. 1 is a rear perspective view of a machinery compartment of an exemplary refrigerator.
Figure 2:
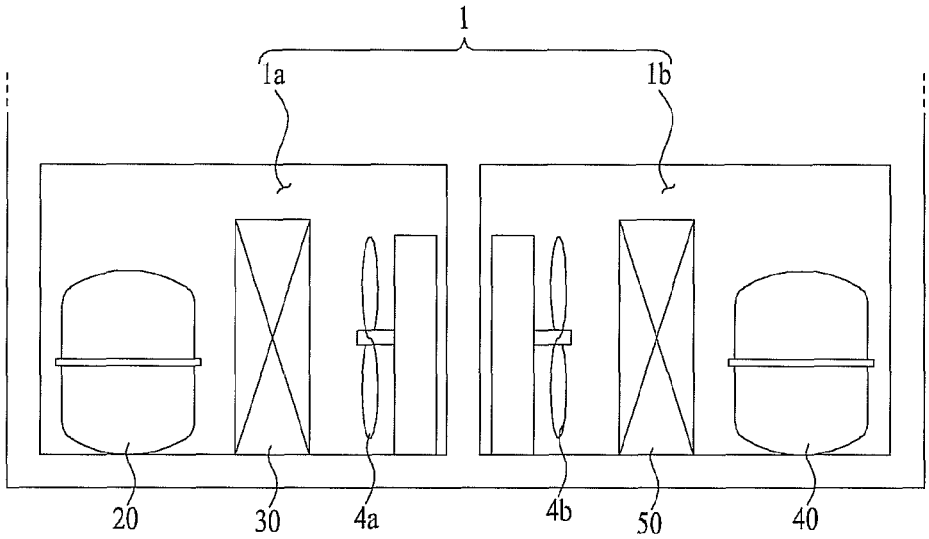
FIG. 2 is a sectional view of a machinery compartment of another exemplary refrigerator.

In the exemplary refrigerator shown in FIGS. 1 and 2, a machinery compartment 1 is formed at a lower end of a refrigerator body 10 and extends in a widthwise direction across back of the refrigerator.

In a side by side type refrigerator, the refrigerator body 10 may be partitioned into left and right spaces in which a freezer compartment and a refrigerator compartment may be respectively provided, and the machinery compartment 1 may be provided under the freezer compartment and the refrigerator compartment, extending across the left and right spaces. As shown in FIG. 1, a compressor 2, a condenser 3, and a fan 4 may be provided in the machinery compartment 1, and a cover 5 may extend across an access opening of the machinery compartment 1. The cover 5 may include a suction port 6 and a discharge port 7 spaced apart from each other by a predetermined distance, though which air may be suctioned into and discharged from the machinery compartment 1. That is, when the fan 4 is rotated, external air may be suctioned into the machinery compartment 1 through the suction port 6, blown to the condenser 3 to absorb heat from refrigerant flowing in the condenser 3 and heat from the compressor 2, and then discharged through the discharge port 7.

As shown in FIG. 2, a larger capacity/size domestic refrigerator or a commercial large-capacity refrigerator may include two compressors 20 and 40, two condensers 30 and 50, and two fans 4*a* and 4*b* respectively installed in a machinery compartment that has been partitioned into a first machinery compartment 1*a* for a freezer compartment and a second machinery compartment 1*b* for a refrigerator compartment. The compressors 20 and 40, condensers 30 and 50, and fans 4*a* and 4*b* installed in this manner may provide increased cooling capacity. However, in such a refrigerator, the number of parts to be installed in the machinery compartments may be relatively large, making it difficult to properly install the compressors, condensers, and fans in relatively small spaces. If size of the compressors, condensers, and/or fans is reduced to provide for installation in the machinery compartments, the capacity of the compressors and/or condensers may be reduced, making it difficult to properly respond to a large cooling load.

A refrigerator as embodied and broadly described herein may include a refrigerator compartment and a freezer compartment defined in a refrigerator body, a refrigerator compartment evaporator for supplying cool air into the refrigerator compartment, a freezer compartment evaporator for supplying cool air into the freezer compartment, a machinery compartment 1 formed at one side of the refrigerator body to define a receiving space, a plurality of compressors 20 and 40 disposed in the receiving space of the machinery compartment 1, a fan 100 disposed in the receiving space of the machinery compartment 1 and located between the compressors 20 and 40, and a guide device including one or more guides 110 and 120 for selectively guiding air blown by the fan to the compressors 20 and/or 40.

Figure 3:
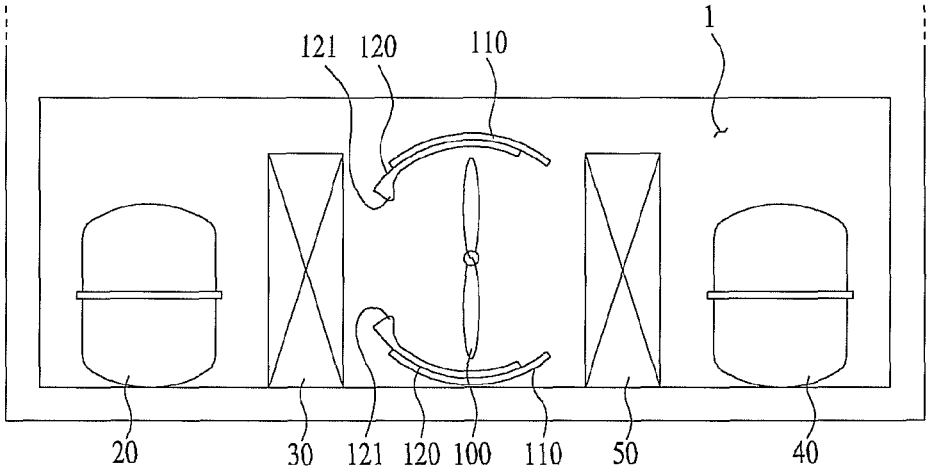
FIG. 3 is a sectional view of a machinery compartment of another exemplary refrigerator.

The machinery compartment 1 shown in FIG. 3 is not partitioned into two compartments as is the machinery compartment shown in FIG. 2, but instead defines a single receiving space so that a single fan 100 may direct cooling flow to one or both sides thereof. In certain embodiments, the fan 100 may be installed at a central portion of the machinery compartment 1 such that the fan 100 may suction external air into the machinery compartment and selectively blow the air in the right direction or in the left direction depending on a position of the guide device 110/120. As shown in FIG. 3, the first compressor 20 may be disposed at the left side of the fan 100, and the second compressor 40 may be disposed at the right side of the fan 100. The first compressor 20 and the second compressor 40 may have substantially the same compression capacity, or different compression capacities.

Generally, the load of a freezer compartment side refrigeration cycle is greater than that of a refrigerator compartment side refrigeration cycle. In a case in which the first compressor 20 is used to cool the freezer compartment and the second compressor 40 is used to cool the refrigerator compartment, therefore, the capacity of the first compressor 20 may be greater than that of the second compressor 40.

The refrigerator shown in FIG. 3 may also include two condensers 30 and 50 installed in the machinery compartment 1 such that the first condenser 30 is located between the fan 100 and the first compressor 20 and the second condenser 50 is located between the fan 100 and the second compressor 40.

In a case in which a pair of compressors is provided as described above, a pair of condensers may be respectively connected to the pair of compressors to more efficiently operate the refrigeration cycle.

The guide device 110/120 may be installed around the fan 100 to control the direction in which air is blown by the fan 100 and the amount of air blown by the fan 100 in a particular direction.

The fan 100 suctions external air into the machinery compartment 1 through a suction port formed at a corresponding portion of a cover 5 of the machinery compartment 1 and blows the air in a horizontal direction, such as, for example, in the left direction in the orientation shown in FIG. 3.

As shown in FIG. 3, the fan 100 may be installed at an intermediate position, such as, for example, the middle of the machinery compartment 1. For this reason, the suction port may be formed at the middle of the cover of the machinery compartment 1 or at the middle bottom of the machinery compartment 1, at a position corresponding to the installation of the fan 100.

An axial fan for suctioning external air into the machinery compartment 1 and blowing the air in the axial direction thereof may be used as the fan 100.

The guide device 110/120 may include one or more stationary guides 110 that surround corresponding portion(s) of the fan 100 and one or more moving guides 120 movably mounted to the one or more stationary guides 110 to open or close an air blowing channel along which air is blown by the fan 100.

The stationary guide 110 may be fixed in the machinery compartment 1 at the middle portion thereof such that stationary guide 110 surrounds upper and lower ends of the fan 100.

The stationary guide 110 may have a spherical or cylindrical shape opened at a side thereof located in front of the fan 100 and a side thereof located at the rear of the fan 100.

In FIG. 3, which is a sectional view, the stationary guide 110 appears to have an accurate shape. However, it is understood that the stationary guide 110 has a spherical shape with circular openings formed at the front and rear sides thereof (i.e., left and right sides thereof in the orientation shown in FIGS. 3-6).

The moving guide 120 may be mounted at, for example, the inside of the stationary guide 110 so that the moving guide 120 may move relative to the stationary guide 110 to open or close the air blowing channel along which air is blown by the fan 100, i.e. the opening formed at one side of the stationary guide 110.

As the stationary guide 110 may have a spherical shape as described above, the moving guide 120 may also have a spherical shape to correspond to that of the stationary guide 110.

The moving guide 120 may include a pair of moving guides, i.e., first and second moving guides 120*a* and 120*b* (see FIGS. 4-6) respectively provided above and under the fan 100 to open or close the opening formed in the stationary guide 110.

Specifically, the moving guide 120 may include the first moving guide 120*a* provided above the fan 100 such that the first moving guide 120*a* slides along a corresponding upper inner circumferential portion of the stationary guide 110 and a second moving guide 120*b* provided under the fan 100 such that the second moving guide 120*b* slides along a corresponding lower inner circumferential portion of the stationary guide 110.

Figure 4:
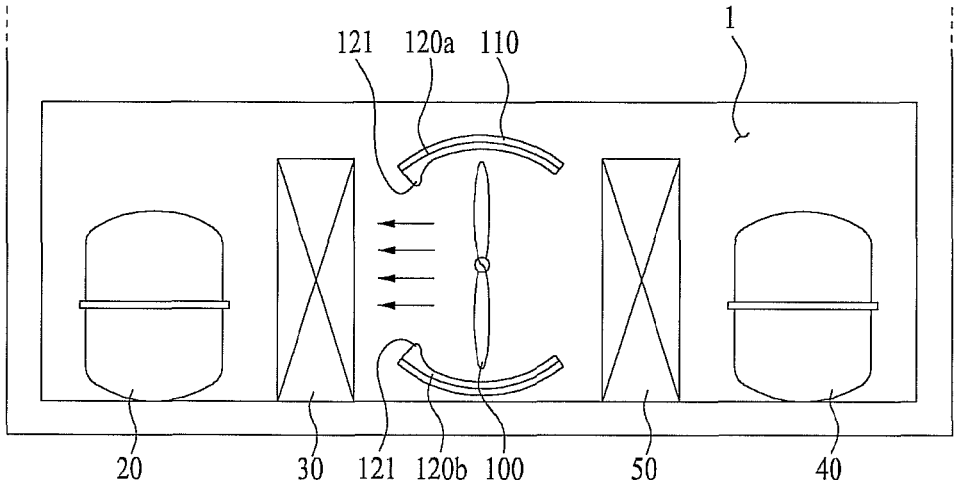
FIG. 4 is a sectional view illustrating a state in which a guide device of the machinery compartment shown in FIG. 3 is fully open.

If the moving guide 120 were instead formed as a single member sliding along either the upper or lower portion of the stationary guide to open or close the opening, air blown by the fan 100 may be excessively supplied to the upper part or the lower part of the corresponding condenser and compressor. As shown in FIG. 4, the first and second moving guides 120*a* and 120*b* are moved away from each other, the first moving guide 120 in an upward direction and the second moving guide 120*b* in a downward direction, to open the opening formed in the stationary guide 110, thereby improving heat exchange efficiency of the condenser.

Also, the first moving guide 120*a* and the second moving guide 120*b* may be symmetric with respect to a horizontal plane.

The first and second moving guides 120*a* and 120*b* may be installed above and under the fan 100, respectively, in a symmetrical fashion to efficiently control the direction in which air is blown by the fan 100 and the amount of air blown by the fan 100.

Each of the first and second moving guides 120*a* and 120*b* may be provided at one end thereof with a protrusion 121 for guiding air such that the air smoothly flows when the blowing direction of the air is changed.

The protrusions 121 may be formed at facing ends of the first and second moving guides 120*a* and 120*b* such that the protrusions 121 protrude inward toward the fan 100.

One side of each of the protrusions 121 may be formed in the shape of a concave curve having a radius of curvature less than the inside radius of curvature of the moving guide 110 to smoothly change the direction in which air is blown by the fan 100.

The other side of each of the protrusions 121 may be formed in a substantially planar shape so that the corresponding sides of the protrusions 121 come into contact with each other to fully close the air blowing channel when the first and second moving guides 120*a* and 120*b* are rotated so that the facing ends of the first and second moving guides 120*a* and 120*b* come into contact with each other.

In the orientation shown in FIGS. 3-6, the "front" may refer to a direction in which air is blown by the fan 100, and the "rear" may refer to a direction opposite to the direction in which air is blown by the fan 100.

Thus, the moving guide 120 may selectively open or close the front opening of the stationary guide 110 to change the direction in which air is blown by the fan 100.

The first and second moving guides 120*a* and 120*b* may be mounted to the stationary guide 110 such that the first and second moving guides 120*a* and 120*b* may be rotated about a horizontal axis.

That is, the moving guide 120 may be formed in the shape of a sphere, in particular, approximately similar to a hemisphere when the first and second moving guides 120*a* and 120*b* come into contact with each other. Consequently, the moving guide 120 may be mounted to the stationary guide 110 such that the moving guide 120 may be rotated about a horizontal axis perpendicular to a rotary shaft of the fan 100 in a state in which the moving guide 120 is in contact with the stationary guide 110.

In certain embodiments, the fan 100 may be installed so as to blow air toward the first compressor 20 when the stationary guide 110 and moving guide 120 are positioned as shown in FIG. 4.

As previously described, refrigeration load of the freezer compartment is typically greater than that of the refrigerator compartment. For this reason, the freezer compartment compressor and condenser may have relatively large capacities, and the fan 100 may be installed such that substantially all of air blown by the fan 100 is directed to the first compressor 20.

Figure 5:
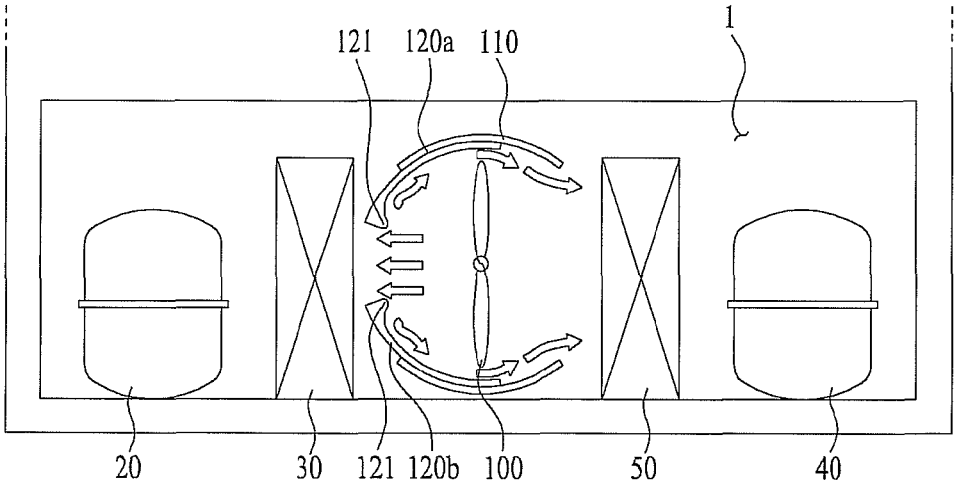
FIG. 5 is a sectional view illustrating a state in which the guide device of the machinery compartment shown in FIG. 3 is partially open.

As the moving guide 120 moves to a position shown in FIG. 5, the moving guide 120 guides some of the air blown by the fan 100 in the left direction, and some of the air in the right direction in order to guide air in opposite directions. Therefore, the amount of the air blown by the fan 100 in the primary air blowing direction is greater than that of the air guided in the secondary blowing direction in this arrangement.

Figure 6:
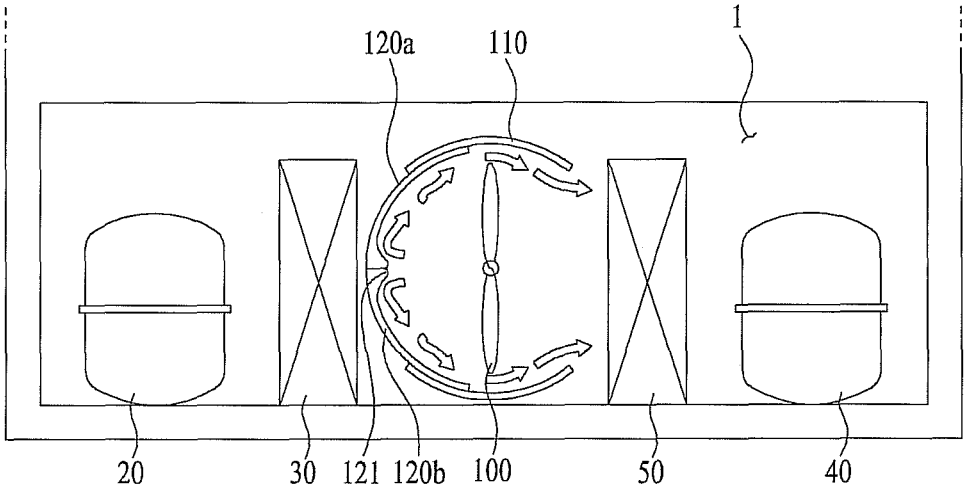
FIG. 6 is a sectional view illustrating in a state in which the guide device of the machinery compartment shown in FIG. 3 is fully closed.

As shown in FIG. 6, the flow direction of the air blown by the fan 100 may be reversed by closing the moving guide 120, with the result that losses due to resistance of the air blowing channel may occur. For this reason, the air, whose flow direction has been changed by the stationary guide 110 and the moving guide 120, is blown to the refrigerator compartment condenser 50, which has a relatively low refrigeration load as the ends of the first and second moving guides 120*a* and 120*b* come into contact with each other to fully close the opening located at the front side of the fan 100, as shown in FIG. 6.

In addition, the ends of the first and second moving guides 120*a* and 120*b* may be moved inward, or apart, again, to the exemplary positions shown in FIGS. 3-5, to easily change the flow direction of the air blown by the fan 100 and an amount of air blown in a particular direction.

Due to the shape of the ends of the first and second moving guides 120*a* and 120*b*, the flow direction of the air blown by the fan 100 may be smoothly changed.

It is noted that air suctioned into the machinery compartment 1 through the suction port may be guided such that the air can pass through the fan 100 located in the guide device 110/120.

Therefore, in certain embodiments a guide duct may extend from the suction port to the fan 100 to guide air in this manner.

Such a guide duct may extend through the stationary guide 110 and the moving guide 120 without interfering with the moving guide 120 as the moving guide 120 is rotated.

Consequently, the guide duct may extend through the center of the rear opening of the stationary guide 110 without interfering with a motor for rotating the fan 100 or a rotary shaft of the motor.

Hereinafter, the operation of the refrigerator, as embodied and broadly described herein, will be described with reference to FIGS. 4 to 6.

In FIG. 4 the guide device is fully open. When the moving guide 120 is rotated to fully open the left opening of the stationary guide 110 as shown in FIG. 4, all of the air blown by the fan 100 flows to the freezer compartment condenser 30 located in the front of the fan 100. At this time, the right opening of the stationary guide 110 remains open; however, the air blown by the fan 100 flows to the left side, as no obstacle(s) for changing the flow direction of the air are positioned in the flow path of the air. Thus, essentially all of the air blown by the fan 100 flows to the left side. In this state, the first compressor 20 and the first condenser 30 may be driven to operate only the freezer compartment side refrigeration cycle. The operation of the fan 100 may be stopped to interrupt both the refrigeration cycles.

In FIG. 5 the guide device 110/120 is partially open. When the moving guide 120 is rotated by a predetermined angle from the fully open state of FIG. 4 to partially close the left opening of the stationary guide 110 as shown in FIG. 5, a first portion of the air blown by the fan 100 flows to the freezer compartment condenser 30 located in front of the fan 100, and the air blowing direction of a second portion of the air is changed by the moving guide 120 and protrusions 121 with the result that the second portion of the air is guided by the moving guide 120 and the stationary guide 110 in the backward direction. The rotation angle of the moving guide 120 may be controlled to adjust the opening degree of the front opening of the stationary guide 110 so that the amount of the air blown in the forward direction and in the backward direction may be appropriately distributed. In this state, the first compressor 10, the first condenser 30, the second compressor 40, and the second condenser 50 may all be driven to simultaneously operate the freezer compartment side refrigeration cycle and the refrigerator compartment side refrigeration cycle.

In FIG. 6 the guide device 110/120 is fully closed. When the moving guide 120 is further rotated from the partially open state of FIG. 5 to fully close the left opening of the stationary guide 110 as shown in FIG. 6, essentially all of the air blown by the fan 100 flows to the refrigerator compartment condenser 50 located at the rear of the fan 100. At this time, the rear opening of the stationary guide 110 remains open and the air blown by the fan 100 is guided by the guide device 110 and 120 to flow in the backward direction. In this state, the second compressor 40 and the second condenser 50 may be driven to operate only the refrigerator compartment side refrigeration cycle.

In embodiments as broadly described herein, the freezer compartment condenser 30 and the refrigerator compartment condenser 50 are installed in the machinery compartment. However, the number of the condensers is not limited to two. For example, only one condenser may be installed in the machinery compartment. Various combinations of components may be appropriate.

For example, a condenser may be installed under the guide device with the condenser installed horizontally, and a suction port may be provided under the condenser. In this case, the fan 100 does not blow air to the condenser. Rather, the fan is installed downstream of the condenser to provide suction force so that external air can pass through the condenser.

In this arrangement, when the fan 100 is driven, external air may be suctioned through the suction port formed at the bottom of the machinery compartment 1, heat exchange between the suctioned air and the condenser may be carried out while the suctioned air passes through the condenser, and the air may be selectively blown to the compressor 20 or 40 by the guide device 110 and 120 around the fan 100.

As described above, in a refrigerator as embodied and broadly described herein, it may be possible to blow air to two compressors using a single fan for achieving heat exchange, thereby efficiently utilizing an interior space of a machinery compartment. Also, when two refrigeration cycles are operated, it may be possible to selectively perform a single operation and a simultaneous operation.

Also, although a motor for rotating the fan may only rotate in one direction, it may be possible to blow air in two opposite directions.

Also, by using a single fan, it may be possible to increase the capacities of the two compressors such that the capacities of the compressors are greater than those of compressors installed in a machinery compartment in which two fans are installed.

Also, it may be possible to selectively blow air in opposite directions using a single fan and, in addition, to control the amount of the blown air so that the air may be simultaneously blown in opposite directions, thereby selectively performing a simultaneous operation of the compressors and/or a single operation of one of the compressors.

A refrigerator having two compressors disposed in a machinery compartment, and a single fan to blow air to the respective compressors is provided.

A refrigerator as embodied and broadly described herein may include a refrigerator compartment and a freezer compartment defined in a refrigerator body, a refrigerator compartment evaporator for supplying cool air into the refrigerator compartment, a freezer compartment evaporator for supplying cool air into the freezer compartment, a machinery compartment formed at one side of the refrigerator body to define a receiving space, a plurality of compressors disposed in the receiving space of the machinery compartment, a fan disposed in the receiving space of the machinery compartment such that the fan is located between the compressors, and a guide unit for guiding air blown by the fan to the compressors to simultaneously cool the plurality of compressors.

The guide unit may include a stationary guide unit disposed at one side of the fan such that the stationary guide unit surrounds the fan and a moving guide unit movably mounted to the stationary guide unit to open or close an air blowing channel along which air is blown by the fan.

The stationary guide unit may be formed in a spherical shape opened at a side thereof located in front of the fan and at a side thereof located at the rear of the fan.

The moving guide unit may include a first moving guide part provided above the fan such that the first moving guide part slides along the bottom of the stationary guide unit and a second moving guide part provided under the fan such that the second moving guide part slides along the top of the stationary guide unit.

The first moving guide part and the second moving guide part may be symmetric with respect to a horizontal plane.

Each of the first and second moving guide parts may be provided at one end thereof with a protrusion for guiding air such that the air smoothly flows when the blowing direction of the air is changed.

The moving guide unit may selectively open or close the front opening of the stationary guide unit.

The moving guide unit may be mounted to the stationary guide unit such that the moving guide unit can be rotated about a horizontal axis.

The plurality of compressors may include a first compressor and a second compressor having a capacity less than that of the first compressor, and the fan may be installed to blow air to the first compressor, the capacity of which is greater than that of the second compressor.

The refrigerator may also include two condensers installed between the fan and the first compressor and between the fan and the second compressor, respectively.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a first compartment and a second compartment defined in a refrigerator body;

a first evaporator that supplies cool air to the first compartment;

a second evaporator that supplies cool air to the second compartment;

a machinery compartment formed in the refrigerator body to define a receiving space;

first and second compressors provided in the receiving space of the machinery compartment;

a fan positioned between the first and second compressors in the receiving space of the machinery compartment; and a guide device that selectively guides air blown by the fan to the first and second compressors to simultaneously cool the first and second compressors, wherein the guide device comprises:

a stationary guide fixed in the machinery room and positioned around the fan, wherein the stationary guide has a substantially spherical shape having a first opening formed at a first side thereof corresponding to a discharge side of the fan and a second opening formed at a second side thereof corresponding to a suction side of the fan; and a moving guide movably coupled to the stationary guide to selectively open and close an air blowing channel defined by the stationary guide along which air is blown by the fan, wherein the moving guide comprises:

a first moving guide slidably coupled to a first inner circumferential portion of the stationary guide positioned above the fan; and a second moving guide slidably coupled to a second inner circumferential portion of the stationary guide positioned below the fan.

2. The refrigerator of claim 1, wherein the first moving guide and the second moving guide are symmetric with respect to a horizontal plane corresponding to a rotational axis of the fan.

3. The refrigerator of claim 2, further comprising a protrusion foamed at a distal end of each of the first and second moving guides, wherein the protrusions are shaped so as to change a blowing direction of air impinging on the protrusions.

4. The refrigerator of claim 1, wherein the moving guide selectively opens and closes the first opening formed in the stationary guide.

5. The refrigerator of claim 4, wherein the moving guide has a plurality of positions with respect to the first opening formed in the stationary guide, including a fully open position in which the moving guide is fully contained within the stationary guide, a partially open position in which the moving guide partially extends into the first opening in the stationary guide so as to partially obstruct the first opening, and a fully closed position in which the moving guide extends completely across the first opening in the stationary guide so as to fully block the first opening.

6. The refrigerator of claim 5, wherein the second opening remains fully open in each of the plurality of positions of the moving guide.

7. The refrigerator of claim 6, wherein substantially all of the air blown by the fan is directed through the first opening with the moving guide in the fully open position, air blown by the fan is directed through both the first and second openings with the moving guide in the partially open position, and all of the air blown by the fan is directed through the second opening with the moving guide in the fully closed position.

8. The refrigerator of claim 1, wherein the moving guide is mounted to the stationary guide such that the moving guide is rotatable about a horizontal axis.

9. The refrigerator of claim 8, further comprising first and second condensers respectively installed between the fan and the first compressor and between the fan and the second compressor.

10. The refrigerator of claim 1, wherein a capacity of the second compressor is less than that of the first compressor, and wherein the fan is installed in the machinery compartment so as to blow air to the first compressor.

11. The refrigerator of claim 1, wherein the machinery compartment comprises a single, unobstructed compartment in which the first and second compressors are each received, and wherein the fan comprises only one fan positioned between the first and second compressors to supply air to both the first and second compressors.

* * * * *